US012616912B2

(12) United States Patent
Qiu

(10) Patent No.: US 12,616,912 B2
(45) Date of Patent: May 5, 2026

(54) POSTURE SENSING TOY

(71) Applicant: Yufu Qiu, Shantou (CN)

(72) Inventor: Yufu Qiu, Shantou (CN)

( * ) Notice: Subject to any disclaimer, the term of this patent is extended or adjusted under 35 U.S.C. 154(b) by 0 days.

(21) Appl. No.: 19/378,173

(22) Filed: Nov. 3, 2025

(65) Prior Publication Data

US 2026/0054192 A1 Feb. 26, 2026

(30) Foreign Application Priority Data

Oct. 9, 2025 (CN) ..... 202522141411.9

(51) Int. Cl.
*A63H 33/26* (2006.01)
*A63H 29/22* (2006.01)
*A63H 33/18* (2006.01)

(52) U.S. Cl.
CPC ..... *A63H 33/26* (2013.01); *A63H 29/22* (2013.01); *A63H 33/18* (2013.01); *A63H 2200/00* (2013.01)

(58) Field of Classification Search
CPC ..... A63H 33/26; A63H 29/22; A63H 33/18; A63H 2200/00
See application file for complete search history.

(56) References Cited

U.S. PATENT DOCUMENTS 11,000,945 B2 * 5/2021 Asada ..... B25J 9/0006
11,110,597 B2 * 9/2021 Polygerinos ..... B25J 9/142
11,690,773 B2 * 7/2023 Song ..... A61H 1/0277 601/33
2009/0277057 A1 11/2009 Nagaoka et al.
2014/0256213 A1 9/2014 Copeland et al.
2015/0217444 A1 * 8/2015 Asada ..... B25J 9/0006 700/258
2016/0360728 A1 12/2016 Bin
2024/0075611 A1 * 3/2024 Jeung ..... B25J 9/106
2025/0178184 A1 * 6/2025 Choi ..... B25J 13/08
2025/0195313 A1 * 6/2025 Morelli ..... B25J 9/0006
2025/0249571 A1 * 8/2025 Shin ..... B25J 9/0006
2025/0268776 A1 * 8/2025 Yu ..... A61H 1/02

* cited by examiner

*Primary Examiner* — Peter J Iannuzzi

(57) ABSTRACT

A posture sensing toy is provided. A circumferential posture sensing mechanism and a pitching posture sensing mechanism that are included in a posture control device are provided, and the circumferential posture sensing mechanism and the pitching posture sensing mechanism are respectively fixedly arranged on a first wearable mechanism and a second wearable mechanism of a wearable device, so that after wearing the toy, a user can trigger a control signal by changing body postures. Meanwhile, a main control mechanism is in communicative connection with the circumferential posture sensing mechanism and the pitching posture sensing mechanism, and the main control mechanism is electrically connected to the circumferential posture sensing mechanism and the pitching posture sensing mechanism respectively, so that a product simplifies a toy operation flow, significantly lowers the difficulty of use, and improves convenience when the circumferential posture sensing mechanism and the pitching posture sensing mechanism act.

10 Claims, 14 Drawing Sheets

POSTURE SENSING TOY

TECHNICAL FIELD

The present disclosure relates to the field of toys, and in particular, to a posture sensing toy.

BACKGROUND

In the field of toys, manufacturers often integrate various movement mechanisms into a single toy to improve the richness of actions of a product. However, in this design mode, it usually requires to arrange independent hardware at a control part of a toy. Each movement mechanism corresponds to a dedicated button, switch, or interface module, to implement precise operations.

However, when a toy is provided with a plurality of movement mechanisms, its control part inevitably needs to be correspondingly provided with a plurality of control mechanisms, which directly causes a user to have to simultaneously operate a plurality of independent devices. This design makes a control process of the toy too complicated, significantly increases the difficulty of operation, and makes it inconvenient to use.

SUMMARY

The present disclosure provides a posture sensing toy, which can solve the problems of high operation difficulty and inconvenience of use while ensuring the richness of actions of a product.

The present disclosure provides a posture sensing toy, including:

a mechanical arm including a supporting mechanism, a main arm mechanism, an actuator, a circumferential adjustment mechanism, a pitching adjustment mechanism, and a main control mechanism, where one end of the main arm mechanism is rotatably arranged on the supporting mechanism; the actuator is rotatably arranged at another end of the main arm mechanism; the circumferential adjustment mechanism is configured to drive the supporting mechanism and the main arm mechanism to relatively rotate; the pitching adjustment mechanism is configured to drive the actuator and the main arm mechanism to relatively rotate; the main control mechanism is arranged on the supporting mechanism; the main control mechanism is electrically connected to the circumferential adjustment mechanism and the pitching adjustment mechanism respectively;

a wearable device including a first wearable mechanism and a second wearable mechanism, where both the first wearable mechanism and the second wearable mechanism are for wearing; the first wearable mechanism is connected to the supporting mechanism; and a posture control device including a circumferential posture sensing mechanism and a pitching posture sensing mechanism, where the circumferential posture sensing mechanism is arranged on the first wearable mechanism; the pitching posture sensing mechanism is arranged on the second wearable mechanism; and the first wearable mechanism and the second wearable mechanism are respectively in communicative connection with the main control mechanism.

Preferably, the circumferential posture sensing mechanism includes a circumferential posture sensor; the circumferential posture sensor is arranged on the first wearable mechanism. The pitching posture sensing mechanism includes a pitching posture sensor. The pitching posture sensor is arranged on the second wearable mechanism.

The main control mechanism includes a main control circuit board. The main control circuit board is arranged inside the supporting mechanism. The main control circuit board is electrically connected to the circumferential adjustment mechanism and the pitching adjustment mechanism respectively. The circumferential posture sensor and the pitching posture sensor are respectively in communicative connection with the main control circuit board.

Preferably, the circumferential posture sensor includes a first gyroscope sensor.

Preferably, the pitching posture sensor includes a second gyroscope sensor.

Preferably, the first wearable mechanism includes a body fixing plate, a cover plate, and a fixed seat; a mounting slot is formed in the body fixing plate; the circumferential posture sensor is arranged in the mounting slot; the cover plate is covered at the mounting slot; and the fixed seat is connected to the body fixing plate.

Preferably, a fixing strap is arranged on the body fixing plate.

Preferably, the body fixing plate is provided with a wearable vest.

Preferably, the second wearable mechanism includes a headset and a battery; the headset is provided with an accommodating cavity; the battery and the pitching posture sensing mechanism are respectively arranged in the accommodating cavity; and the battery is electrically connected to the pitching posture sensing mechanism.

Preferably, the supporting mechanism includes a supporting seat and a buckle; the buckle is arranged on the supporting seat; the main arm mechanism is rotatably arranged on the supporting seat; the supporting seat is detachably arranged on the first wearable mechanism; and the buckle is movably fastened to the first wearable mechanism.

Preferably, the circumferential adjustment mechanism includes a circumferential adjustment motor, a circumferential adjustment gear set, a circumferential driving gear, and a circumferential driving shaft; the circumferential adjustment motor is arranged on the supporting seat; the circumferential adjustment motor is electrically connected to the main control mechanism; the circumferential adjustment motor is in driving connection to the circumferential adjustment gear set; the circumferential adjustment gear set is meshed with the circumferential driving gear; the circumferential driving shaft is arranged on the main arm mechanism; and the circumferential driving shaft is inserted into the circumferential driving gear.

The circumferential adjustment motor is configured to drive the circumferential driving gear to rotate through the circumferential adjustment gear set, so that the circumferential driving gear drives the main arm mechanism to rotate through the circumferential driving shaft.

Preferably, the pitching adjustment mechanism includes a pitching adjustment motor, a pitching adjustment gear set, a pitching driving gear, and a pitching driving shaft; the pitching adjustment motor is arranged on the main arm mechanism; the pitching adjustment motor is electrically connected to the main control mechanism; the pitching adjustment motor is in driving connection to the pitching adjustment gear set; the pitching driving gear is meshed with the pitching adjustment gear set; the pitching driving shaft is arranged on the actuator; and the pitching driving shaft is inserted into the pitching driving gear.

The pitching adjustment motor is configured to drive the pitching driving gear to rotate through the pitching adjustment gear set, so that the pitching driving gear drives the actuator to rotate through the pitching driving shaft.

Preferably, the actuator includes an actuator base and a launching assembly; the actuator base is rotatably arranged on the main arm mechanism; the launching assembly is arranged on the actuator base; the launching assembly is electrically connected to the main control mechanism; and the launching assembly includes a soft bullet launching element or a water bullet launching element.

Preferably, the posture sensing toy further includes a control device; the control device includes a handle, a control circuit board, a plurality of control buttons, and a plurality of control switches; the control circuit board is arranged inside the handle; the control switches are respectively connected to the control circuit board; the control buttons are respectively movably arranged on the handle; the control buttons resist against the control buttons in a one-to-one correspondence manner; and the control circuit board is in communicative connection with the main control mechanism.

The present disclosure has the following beneficial effects:

The present disclosure relates to a posture sensing toy. The circumferential posture sensing mechanism and the pitching posture sensing mechanism that are included in the posture control device are provided, and the circumferential posture sensing mechanism and the pitching posture sensing mechanism are respectively fixedly arranged on the first wearable mechanism and the second wearable mechanism of the wearable device, so that after wearing the toy, a user can trigger a control signal by changing body postures.

Meanwhile, the main control mechanism is in communicative connection with the circumferential posture sensing mechanism and the pitching posture sensing mechanism, and the main control mechanism is electrically connected to the circumferential posture sensing mechanism and the pitching posture sensing mechanism respectively, so that a product simplifies a toy operation flow, significantly lowers the difficulty of use, and improves convenience when the circumferential posture sensing mechanism and the pitching posture sensing mechanism act.

BRIEF DESCRIPTION OF THE DRAWINGS

The exemplary implementations of the present disclosure will be described in more details by combining the accompanying drawings. The above and other objectives, features, and advantages of the present disclosure will become more obvious. In the exemplary implementations of the present disclosure, the same reference numerals generally represent the same components.

DETAILED DESCRIPTION OF THE EMBODIMENTS

Figure 1:
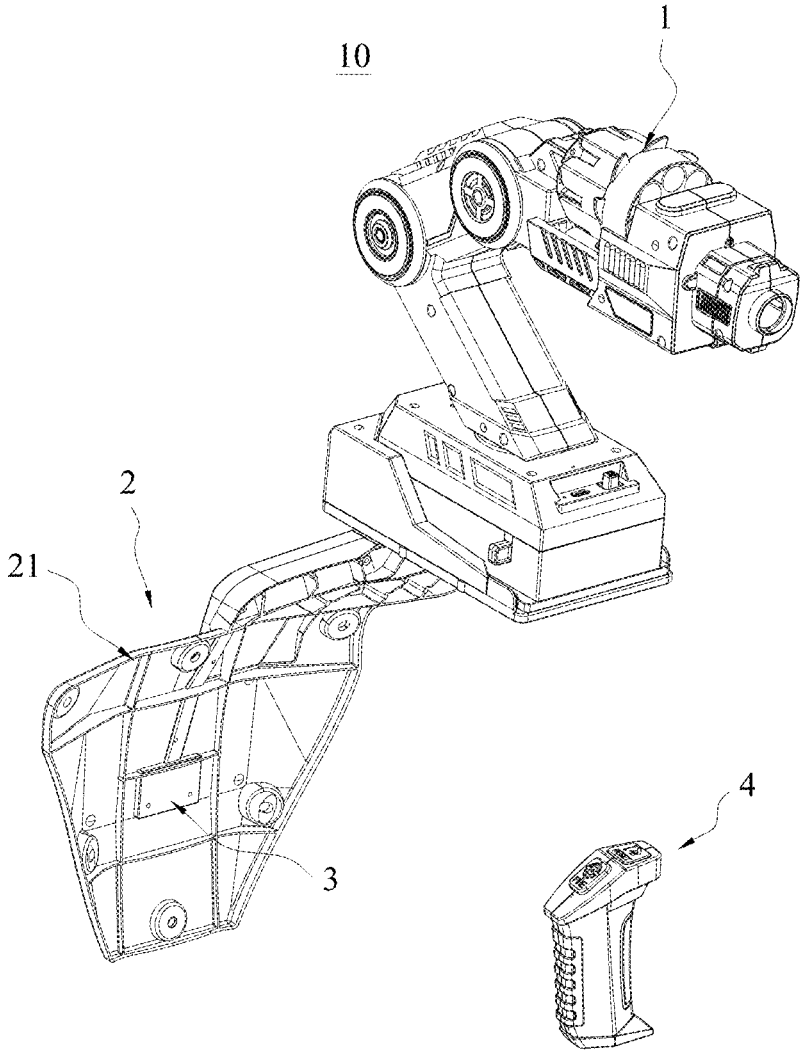
FIG. 1 is a schematic structural diagram of a posture sensing toy in some embodiments of the present disclosure.

The implementations of the present disclosure will be described in more details below with reference to the accompanying drawings. Although the accompanying drawings show the exemplary implementations of the present disclosure, it should be understood that the present disclosure can be implemented in various forms, and should not be limited to the implementations stated herein. Rather, these implementations are provided for understanding the present disclosure more thoroughly and completely, and can completely transfer the scope of the present disclosure to those skilled in the art.

It should be understood that although various information may be described using terms such as "first", "second", and "third" in the present disclosure, such information should not be limited to these terms. These terms are only used to distinguish information of the same type from each other. For example, without departing from the scope of the present disclosure, the first information can also be referred to as the second information, and similarly, the second information can also be referred to as the first information. Thus, features defined as "first" and "second" explicitly or implicitly include one or more of the features. In the description of the present disclosure, "plurality" means two or more, unless otherwise expressly and specifically defined.

In the descriptions of the present disclosure, it should be understood that orientations or positional relationships indicated by the terms "length", "width", "upper", "lower", "front", "rear", "left", "right", "vertical", "horizontal", "top", "bottom", "inner", "outer", and the like are orientations or positional relationships as shown in the drawings, and are only for the purpose of facilitating and simplifying the descriptions of the present disclosure instead of indicating or implying that devices or elements indicated must have particular orientations, and be constructed and operated in the particular orientations, so that these terms are not construed as limiting the present disclosure.

Unless otherwise expressly specified and limited, the terms "mount", "connect", "connection", "fix" the like should be understood in a broad sense, such as, a fixed connection, a detachable connection, an integrated connection, a mechanical connection, an electrical connection, a direct connection, an indirect connection through an intermediate medium, an internal communication of two elements, or interaction between two elements. For those of ordinary skill in the art, the specific meanings of the aforementioned terms in the present disclosure can be understood based on specific conditions.

Figure 2:
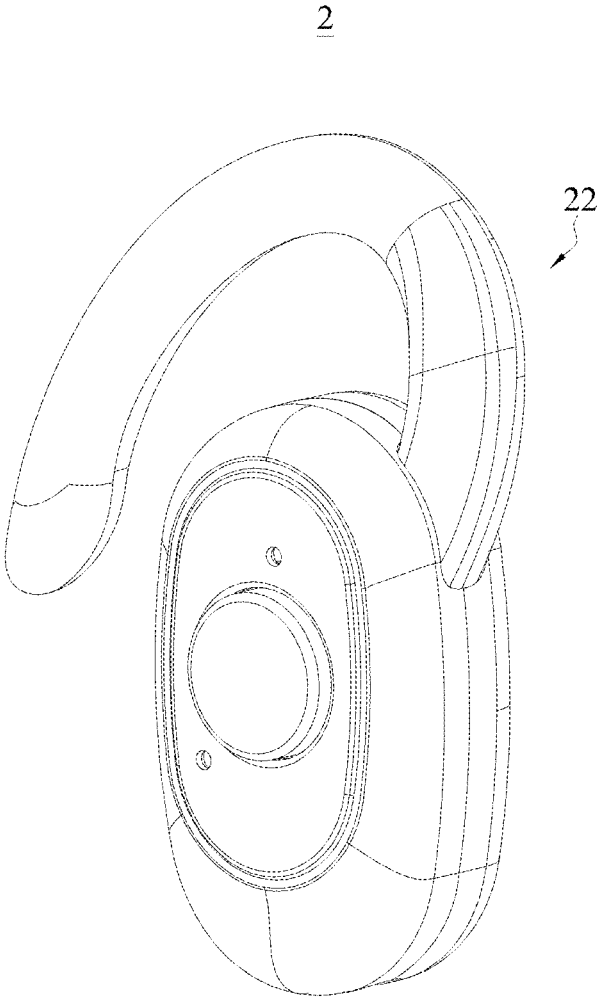
FIG. 2 is a schematic partially structural diagram of a posture sensing toy in some embodiments of the present disclosure.

FIG. 1 and FIG. 2 show a posture sensing toy 10 in some embodiments of the present disclosure. The posture sensing toy 10 includes a mechanical arm 1, a wearable device 2, and a posture control device 3. The mechanical arm 1 is arranged on the wearable device 2, and the posture control device 3 is arranged on the wearable device 2.

It should be noted that the wearable device 2 is for wearing by a user. A specific wearing position can be flexibly set. The appearance of the wearable device 2 can also be correspondingly set based on a wearing position designed for a product, so that the wearable device 2 can be fixed in a predetermined position on a human body.

As shown in FIG. 1 to FIG. 6, the mechanical arm 1 includes a supporting mechanism 11, a main arm mechanism 12, an actuator 13, a circumferential adjustment mechanism 14, a pitching adjustment mechanism 15, and a main control mechanism 16. One end of the main arm mechanism 12 is rotatably arranged on the supporting mechanism 11. The actuator 13 is rotatably arranged at another end of the main arm mechanism 12. The circumferential adjustment mechanism 14 is configured to drive the supporting mechanism 11 and the main arm mechanism 12 to relatively rotate. The pitching adjustment mechanism 15 is configured to drive the actuator 13 and the main arm mechanism 12 to relatively rotate. The main control mechanism 16 is arranged on the supporting mechanism 11. The main control mechanism is electrically connected to the circumferential adjustment mechanism 14 and the pitching adjustment mechanism 15 respectively.

The wearable device 2 includes a first wearable mechanism 21 and a second wearable mechanism 22. Both the first wearable mechanism 21 and the second wearable mechanism 22 are for wearing. The first wearable mechanism 21 is connected to the supporting mechanism 11.

The posture control device 3 includes a circumferential posture sensing mechanism 31 and a pitching posture sensing mechanism 32. The circumferential posture sensing mechanism 31 is arranged on the first wearable mechanism 21. The pitching posture sensing mechanism 32 is arranged on the second wearable mechanism 22. The first wearable mechanism 21 and the second wearable mechanism 22 are respectively in communicative connection with the main control mechanism 16.

It can be understood that the supporting mechanism 11 is configured to provide a stable and reliable support for the main arm mechanism 12, to ensure motion steadiness and reliability of the main arm mechanism 12 and the actuator 13. In one aspect, the main arm mechanism 12 is configured to drive the actuator 13 to rotate in a circumferential direction relative to the supporting mechanism 11 under the driving of the circumferential adjustment mechanism 14. In another aspect, the main arm mechanism 12 is also configured to support rotation of the actuator 13 in a pitching direction. The actuator 13 is configured to perform an end operation task of the mechanical arm 1 (such as launching, grasping, audio-visual feedback, or other types of feedback). The circumferential adjustment mechanism 14 is configured to: make a response to an instruction of the main control mechanism 16 and drive the supporting mechanism 11 and the main arm mechanism 12 to relatively rotate, thus adjusting a circumferential orientation of the mechanical arm 1. The pitching adjustment mechanism 15 is configured to: make a response to an instruction of the main control mechanism 16 and drive the actuator 13 and the main arm mechanism 12 to relatively rotate, thus adjusting a pitching angle of the actuator 13. The main control mechanism 16 is configured to: receive signals from the circumferential posture sensing mechanism 31 and the pitching posture sensing mechanism 32, and harmonically control actions of the circumferential adjustment mechanism 14 and the pitching adjustment mechanism 15 based on the signals, thus achieving synchronization of an overall posture response.

The circumferential posture sensing mechanism 31 is configured to: sense a circumferential rotation posture change of the body of a user and generate a corresponding circumferential control signal to trigger circumferential motion of the mechanical arm 1. The pitching posture sensing mechanism 32 is configured to: sense a pitching tilting posture change of the body of the user and generate a corresponding circumferential control signal to trigger pitching motion of the actuator 13. The wearable device 2 is configured to fix the posture sensing toy 10 to the body of the user, so that the posture control device 3 can directly sense posture changes of the user.

The first wearable mechanism 21 is configured to fix the supporting mechanism 11 to a first part (such as the shoulders, the waist, or other parts of the body) of the body of the user. Certainly, the first wearable mechanism can be configured to be simultaneously connected to two or more parts of the body. The first wearable mechanism 21 is further configured to carry the circumferential posture sensing mechanism 31 to obtain a circumferential posture signal. The second wearable mechanism 22 is configured to be fixed to a second part (such as the head, the hands, or other parts) of the body of the user, and the second wearable mechanism 22 is also configured to mount the pitching posture sensing mechanism 32 to capture a pitching posture signal.

It should be noted that the present disclosure directly senses changes in the posture change of the body of the user through the circumferential posture sensing mechanism 31 and the pitching posture sensing mechanism 32 to generate control signals. The user can trigger the mechanical arm 1 to act without an additional controller or a complex input, thus greatly reducing the number of operation steps. The main control mechanism 16 integrates signals from the first wearable mechanism 21 and the second wearable mechanism 22, and automatically harmonizes the circumferential adjustment mechanism 14 and the pitching adjustment mechanism 15, so that it is intuitive and easy to learn toy control, and the age universality of the product is improved. In conjunction with a posture sensing system, the fixed design of the wearable device 2 allows the user to control the mechanical arm 1 through natural posture changes during movement, thus improving flexibility and comfort in use.

In addition, the independent driving on the circumferential adjustment mechanism 14 and the pitching adjustment mechanism 15 implements multi-degree-of-freedom adjustment, and improves the interactivity and practicality of the toy.

Figure 7:
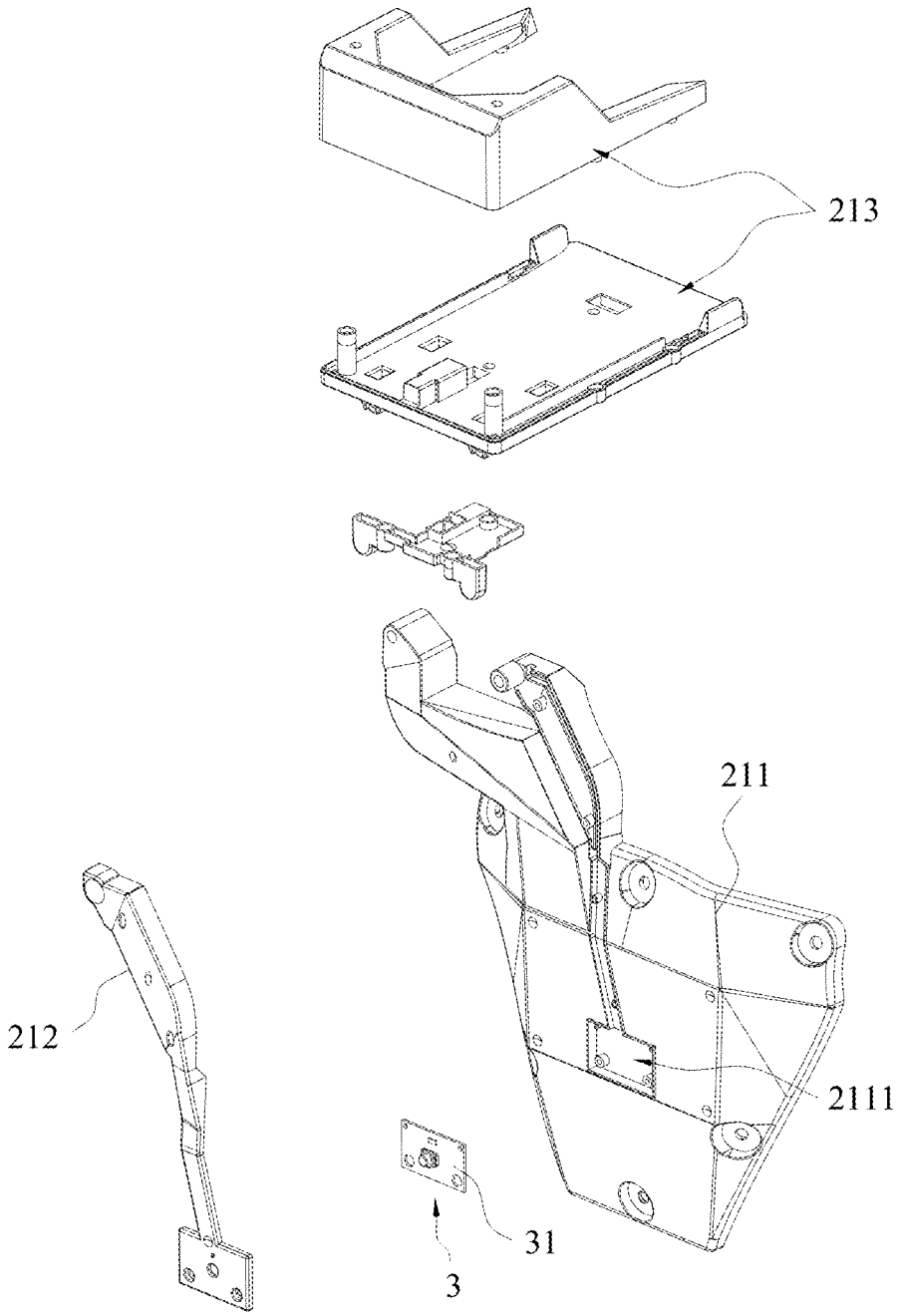
FIG. 7 is a schematic structural diagram of a wearing device and a posture control device in some embodiments of the present disclosure.

As shown in FIG. 1 and FIG. 7, in some embodiments of the posture sensing toy 10, the circumferential posture sensing mechanism 31 includes a circumferential posture sensor. The circumferential posture sensor is arranged on the first wearable mechanism 21. The pitching posture sensing mechanism 32 includes a pitching posture sensor. The pitching posture sensor is arranged on the second wearable mechanism 22.

Figure 5:
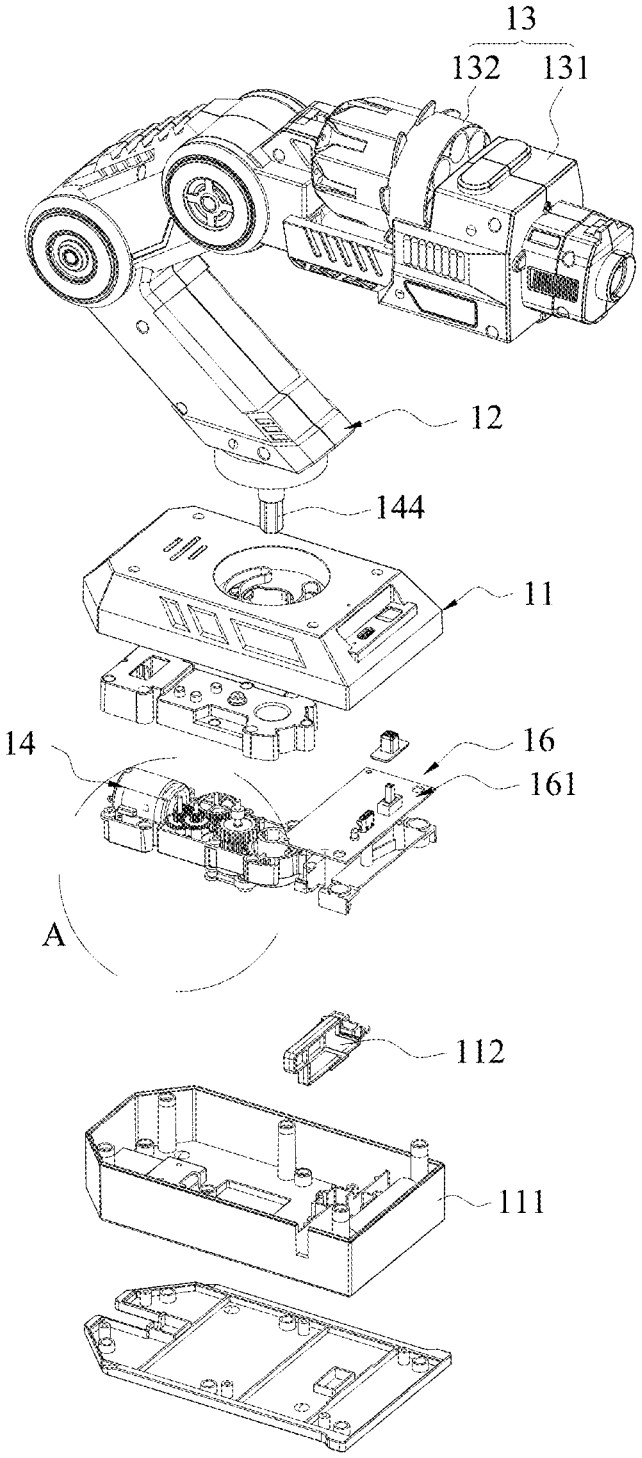
FIG. 5 is a partially structural exploded view of the posture sensing toy shown in FIG. 4.

As shown in FIG. 5, the main control mechanism 16 includes a main control circuit board 161. The main control circuit board 161 is arranged inside the supporting mechanism 11. The main control circuit board 161 is electrically connected to the circumferential adjustment mechanism 14 and the pitching adjustment mechanism 15 respectively. The circumferential posture sensor and the pitching posture sensor are respectively in communicative connection with the main control circuit board 161.

It can be understood that the circumferential posture sensor is configured to: precisely detect a change in a rotation angle of the body of the user in a horizontal plane, convert this change into an electrical signal, and send the electrical signal to the main control circuit board 161.

The pitching posture sensor is configured to: precisely detect a change in a tilting angle of a specific wearing position on the body of the user (for example, head pitching or hand pitching), convert this change into an electrical signal, and send the electrical signal to the main control circuit board 161.

The main control circuit board 161 is configured to: integrate and process the signals sent by the circumferential posture sensor and the pitching posture sensor, and further generate corresponding driving instructions based on the signals. Subsequently, the main control circuit board 161 directly controls a rotation amplitude and direction of the circumferential adjustment mechanism 14 and a rotation angle and speed of the pitching adjustment mechanism 15 based on an electrical connection relationship, thus achieving synchronous mapping between an action of the mechanical arm 1 and a posture of the user.

Specifically, the circumferential posture sensor includes a first gyroscope sensor. The first gyroscope sensor dynamically captures a circumferential posture through angular velocity measurement, which ensures high responsiveness and anti-interference performance of the circumferential control signal.

Specifically, the pitching posture sensor includes a second gyroscope sensor. The second gyroscope sensor dynamically captures a pitching posture through angular velocity measurement, which ensures instantaneity and stability of the pitching control signal.

Figure 4:
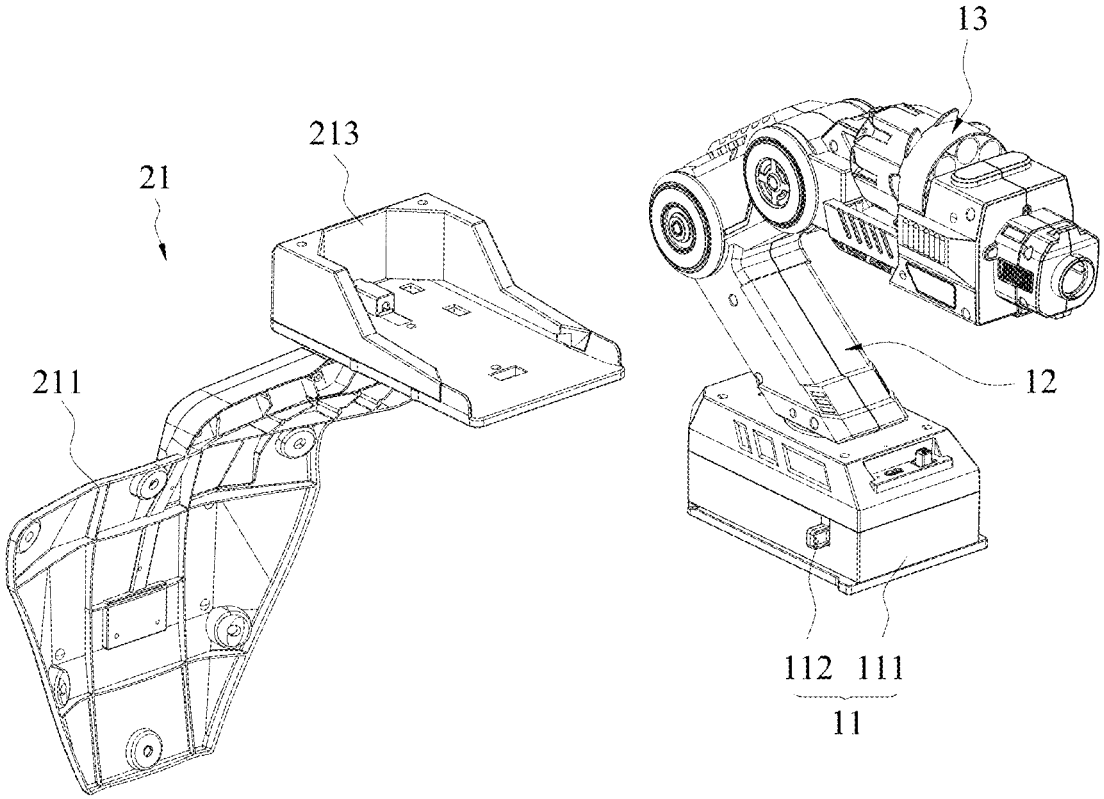
FIG. 4 is a schematic exploded view of the posture sensing toy shown in FIG. 1.

As shown in FIG. 4 and FIG. 7, in some embodiments of the posture sensing toy 10, the first wearable mechanism 21 includes a body fixing plate 211, a cover plate 212, and a fixed seat 213. A mounting slot 2111 is formed in the body fixing plate 211. The circumferential posture sensor is arranged in the mounting slot 2111. The cover plate 212 is covered at the mounting slot 2111. The fixed seat 213 is connected to the body fixing plate 211.

It can be understood that the mounting slot 2111 is formed in the body fixing plate 211, and the circumferential posture sensor is arranged in the mounting slot 2111. The mounting slot 2111 plays a role of limiting and protecting the sensor and avoids displacement or impact damage. The cover plate 212 is covered at the mounting slot 2111 to achieve effects of sealing the circumferential posture sensor, blocking dust and liquid, and improving durability. The fixed seat 213 plays a role of connecting the supporting mechanism 11.

In some embodiments of the posture sensing toy 10, the body fixing plate 211 is provided with a fixing strap (not shown). It can be understood that the fixing strap can adapt to different body types and abut against a body by using an adjustable binding force.

In some embodiments of the posture sensing toy 10, the body fixing plate 211 is provided with a wearable vest. It can be understood that the wearable vest in this embodiment can disperse a load on the mechanical arm and improve a comfort level in long-term wearing.

Figure 3:
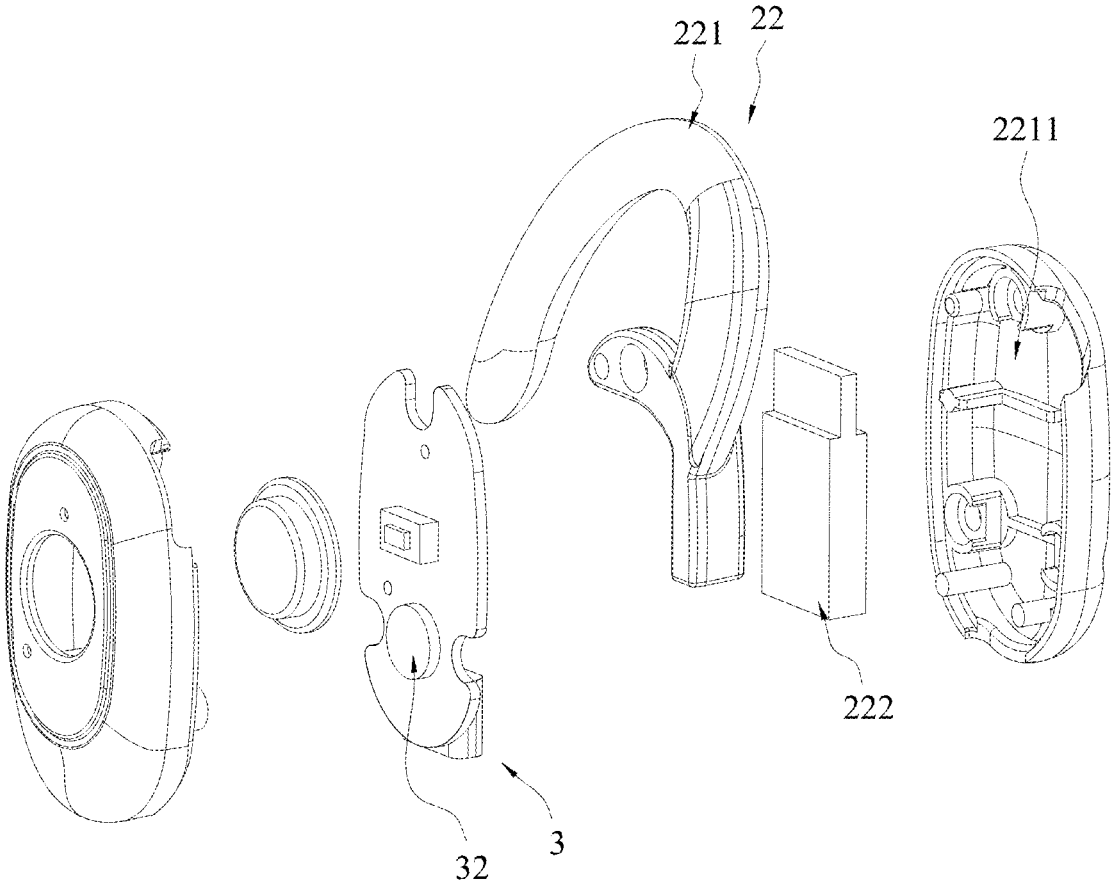
FIG. 3 is an exploded view of the posture sensing toy shown in FIG. 2.

As shown in FIG. 3, in some embodiments of the posture sensing toy 10, the second wearable mechanism 22 includes a headset 221 and a battery 222. The headset 221 is provided with an accommodating cavity 2211. The battery 222 and the pitching posture sensing mechanism 32 are respectively arranged in the accommodating cavity 2211. The battery 222 is electrically connected to the pitching posture sensing mechanism 32.

It can be understood that the accommodating cavity 2211 plays a role of storing and fixing the battery 222 and the pitching posture sensing mechanism 32. The headset 221 is fixed at an ear of the user. The battery 222 performs independent power supplying to ensure continuity of signal acquisition and supports modular replacement.

Figure 6:
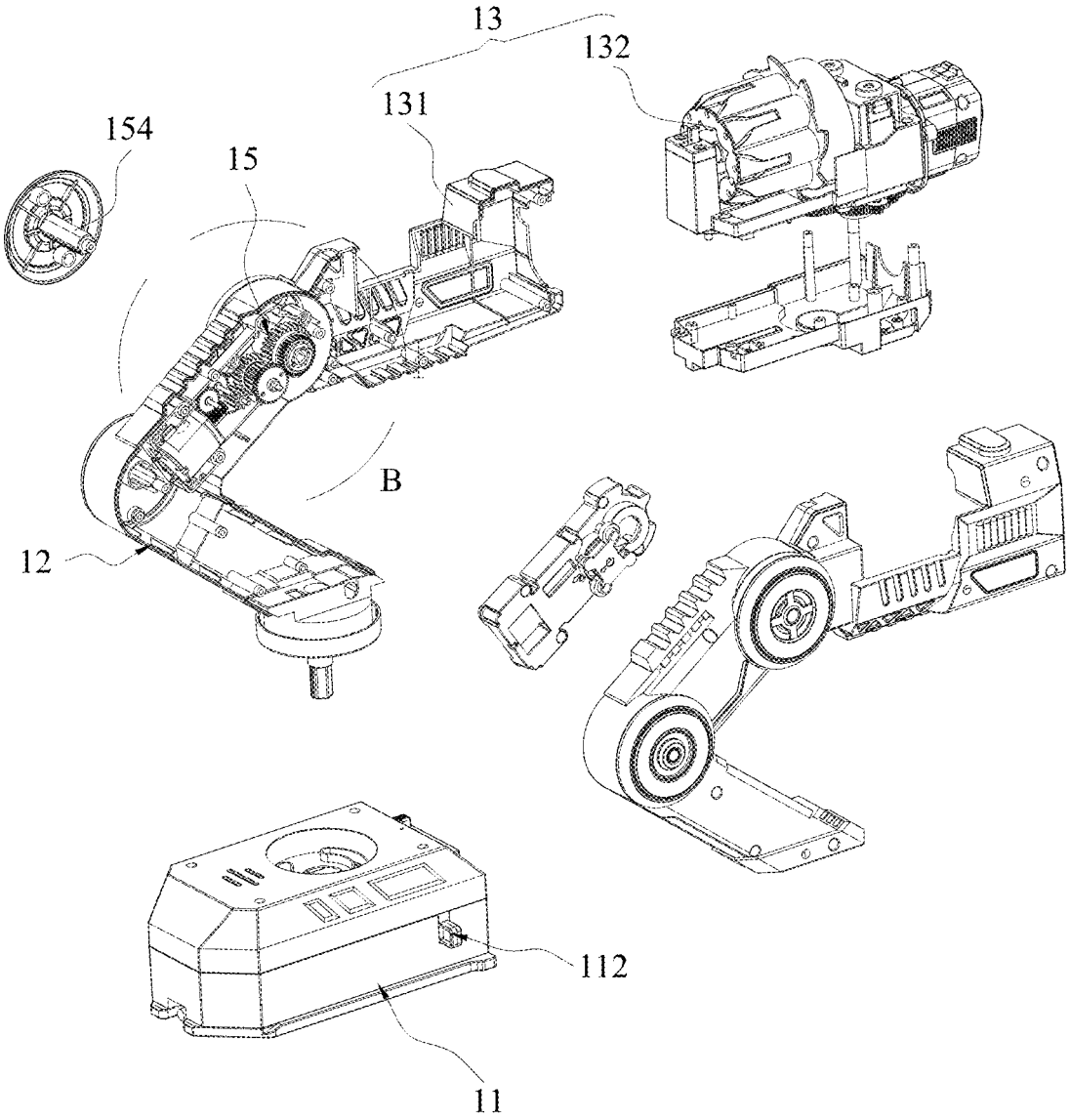
FIG. 6 is another partially structural exploded view of the posture sensing toy shown in FIG. 4.

As shown in FIG. 4, FIG. 5, and FIG. 6, in some embodiments of the posture sensing toy 10, the supporting mechanism 11 includes a supporting seat 111 and a buckle 112. The buckle 112 is arranged on the supporting seat 111. The main arm mechanism 12 is rotatably arranged on the supporting seat 111. The supporting seat 111 is detachably arranged on the first wearable mechanism 21. The buckle 112 is movably fastened to the first wearable mechanism 21.

It can be understood that the supporting seat 111 plays a role of supporting rotation of the main arm mechanism 12 and is detachably assembled to the first wearable mechanism 21, thus achieving quick mounting and removal of the mechanical arm 1. The buckle 112 can prevent the supporting seat 111 from being detached when the mechanical arm 1 moves, and can also quickly remove the mechanical arm 1 if necessary.

Figure 8:
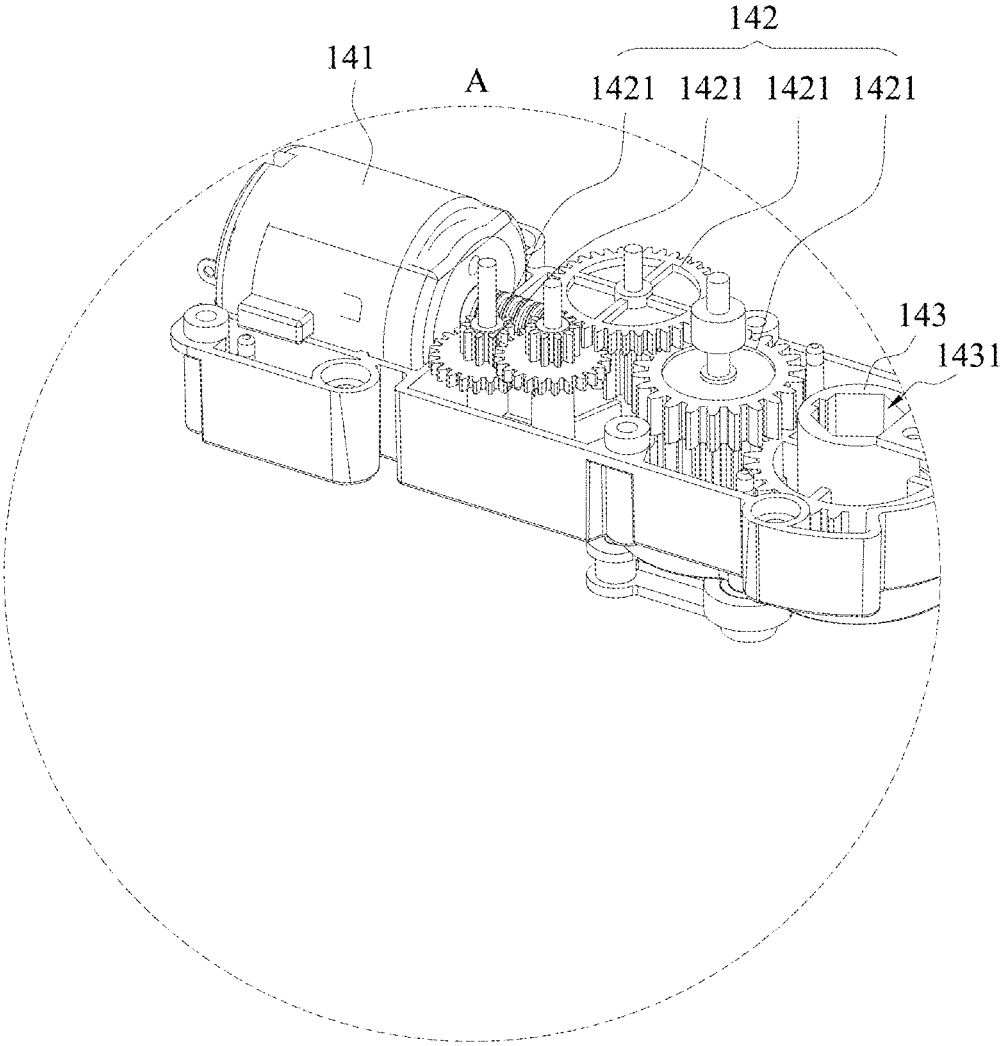
FIG. 8 is an enlarged view of part A of the posture sensing toy shown in FIG. 5.

As shown in FIG. 5 and FIG. 8, in some embodiments of the posture sensing toy 10, the circumferential adjustment mechanism 14 includes a circumferential adjustment motor 141, a circumferential adjustment gear set 142, a circumferential driving gear 143, and a circumferential driving shaft 144. The circumferential adjustment motor 141 is arranged on the supporting seat 111. The circumferential adjustment motor 141 is electrically connected to the main control mechanism 16. The circumferential adjustment motor 141 is in driving connection to the circumferential adjustment gear set 142. The circumferential adjustment gear set 142 is meshed with the circumferential driving gear 143. The circumferential driving shaft 144 is arranged on the main arm mechanism 12. The circumferential driving shaft 144 is inserted into the circumferential driving gear 143.

The circumferential adjustment motor 141 is configured to drive the circumferential driving gear 143 to rotate through the circumferential adjustment gear set 142, so that the circumferential driving gear 143 drives the main arm mechanism 12 to rotate through the circumferential driving shaft 144.

It can be understood that the circumferential adjustment motor 141 is configured to start, stop, and clockwise/anticlockwise rotate under the control of the main control mechanism 16. A torque output by the circumferential adjustment motor 141 can be transferred to the circumferential adjustment gear set 142 and transferred to the circumferential driving gear 143 through gears in the circumferential adjustment gear set 142. The circumferential driving gear 143 can drive the circumferential driving shaft 144 to rotate when it rotates. The circumferential driving shaft 144 serves as a rotation axis of the main arm mechanism 12 to directly drive the main arm mechanism 12 to rotate in the circumferential direction relative to the supporting mechanism 11.

It should be noted that by reducing motor speed fluctuation by multi-stage transmission in the circumferential adjustment gear set 142, smooth and unblocked rotation of the main arm mechanism 12 is ensured.

Specifically, as shown in FIG. 8, in some embodiments, the circumferential adjustment gear set 142 includes a plurality of circumferential transmission gears 1421. The circumferential transmission gears 1421 are rotatably arranged on the supporting seat 111 and are meshed in sequence. One circumferential transmission gear 1421 is directly connected to an output shaft of the circumferential adjustment motor 141, and another circumferential transmission gear 1421 is meshed with the circumferential driving gear 143.

It can be understood that when working to output a torque, the circumferential adjustment motor 141 drives the directly connected circumferential transmission gear 1421 to rotate, thereby driving the circumferential driving gear 143 to rotate through the circumferential transmission gears 1421, and then driving the circumferential driving shaft 144 to rotate through the circumferential driving gear 143. The circumferential driving shaft 144 then drives the main arm mechanism 12 to rotate in the circumferential direction.

Specifically, as shown in FIG. 8, a circumferential torque hole 1431 is formed in the circumferential driving gear 143. The circumferential torque hole 1431 is configured to insert the circumferential driving shaft 144. The circumferential driving shaft 144 resists against a hole wall of the circumferential torque hole 1431.

It can be understood that when the circumferential driving gear 143 rotates, the circumferential driving gear 143 can rotate against the circumferential driving shaft 144 through the hole wall of the circumferential torque hole 1431, thereby implementing circumferential rotation of the main arm mechanism 12.

Figure 9:
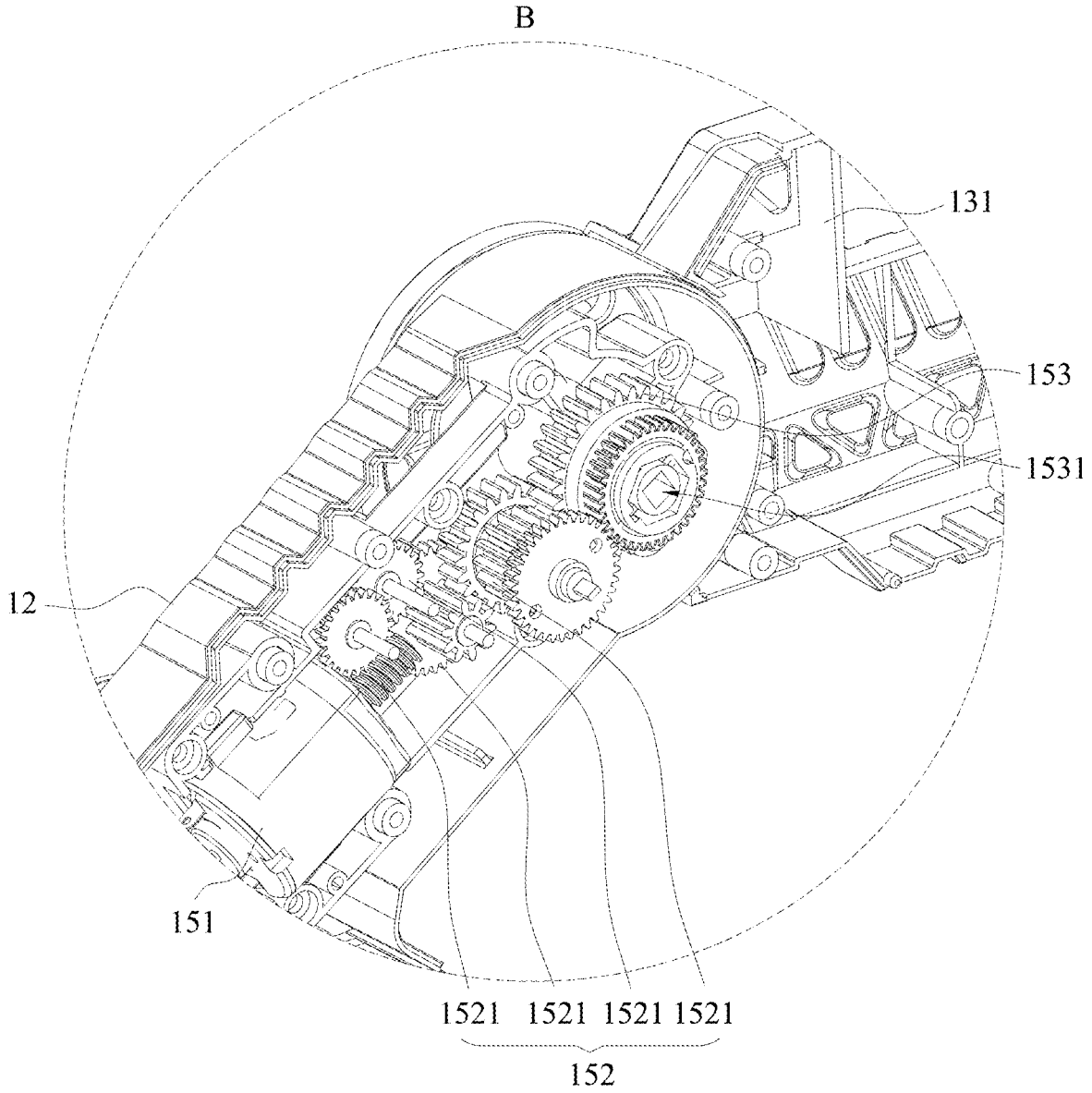
FIG. 9 is an enlarged view of part B of the posture sensing toy shown in FIG. 6.

As shown in FIG. 6 and FIG. 9, in some embodiments of the posture sensing toy 10, the pitching adjustment mechanism 15 includes a pitching adjustment motor 151, a pitching adjustment gear set 152, a pitching driving gear 153, and a pitching driving shaft 154. The pitching adjustment motor 151 is arranged on the main arm mechanism 12. The pitching adjustment motor 151 is electrically connected to the main control mechanism 16. The pitching adjustment motor 151 is in driving connection to the pitching adjustment gear set 152. The pitching driving gear 153 is meshed with the pitching driving gear set 152. The pitching driving shaft 154 is arranged on the actuator 13. The pitching driving shaft 154 is inserted into the pitching driving gear 153.

The pitching adjustment motor 151 is configured to drive the pitching driving gear 153 to rotate through the pitching adjustment gear set 152, so that the pitching driving gear 153 drives the actuator 13 to rotate through the pitching driving shaft 154.

It can be understood that the pitching adjustment motor 151 is configured to start, stop, and clockwise/anticlockwise rotate under the control of the main control mechanism 16. When working, the pitching adjustment motor 151 outputs a torque to the pitching adjustment gear set 152, and a plurality of gears of gears in the pitching adjustment gear set 152 further transfer the torque to the pitching driving gear 153, to cause the pitching driving gear 153 to rotate. The pitching driving gear 153 is configured to drive the pitching driving shaft 154 to rotate together, thereby driving the actuator 13 to swing up and down through the pitching driving shaft 154.

It should be noted that based on the content of this embodiment, adjustment on a pitching angle of the actuator 13 can be implemented.

Specifically, as shown in FIG. 9, in some embodiments, the pitching adjustment gear set 152 includes a plurality of pitching transmission gears 1521 which are respectively rotatably mounted on the main arm mechanism 12 and are meshed in sequence. One pitching transmission gear 1521 is directly connected to an output shaft of the pitching adjustment motor 151, while another pitching transmission gear 1521 is meshed with the pitching driving gear 153.

It can be understood that when the pitching adjustment motor 151 works, the output shaft can drive the pitching transmission gear 1521 directly connected to the pitching adjustment motor 151 to rotate. Subsequently, the torque can be transferred stage by stage to the pitching driving gear 153 through the pitching transmission gears 1521, thereby driving the pitching driving gear 153 to rotate, and then driving the pitching driving shaft 154 to rotate through the pitching driving gear 153, so that the pitching driving shaft 154 drives the actuator 13 to rotate in the pitching direction, to achieve a purpose of pitching angle adjustment.

Specifically, as shown in FIG. 6 and FIG. 9, a pitching driving hole 1531 is formed in the pitching driving gear 153, and the pitching driving shaft 154 is inserted into the pitching driving hole 1531.

It can be understood that when rotating, the pitching driving gear 153 can drive the pitching driving shaft 154 to rotate through a hole wall of the pitching driving hole 1531.

As shown in FIG. 5 and FIG. 6, in some embodiments of the posture sensing toy 10, the actuator 13 includes an actuator base 131 and a launching assembly 132. The actuator base 131 is rotatably arranged on the main arm mechanism 12. The launching assembly 132 is arranged on the actuator base 131. The launching assembly 132 is electrically connected to the main control mechanism 16. The launching assembly 132 includes a soft bullet launching element or a water bullet launching element.

It can be understood that the actuator base 131 is configured to mount and support the launching assembly 132, and the actuator base 131 is also configured to drive the launching assembly 132 to move together, to implement circumferential adjustment and pitching adjustment on the launching assembly 132 in a launching direction.

It should be noted that in some embodiments, the launching assembly 132 can be configured to employ the soft bullet launching element in the existing art or various types of soft bullet launching structures, while in some other embodiments, the launching assembly 132 can be configured to employ the water bullet launching element in the existing art or various types of water bullet launching elements. Since this embodiment is mainly to adjust an launching angle, specific use of a structure or launching of a type of launched object is not within the scope of protection of the present disclosure. Therefore, the specific structure of the launching assembly 132 will not be further elaborated.

Figure 10:
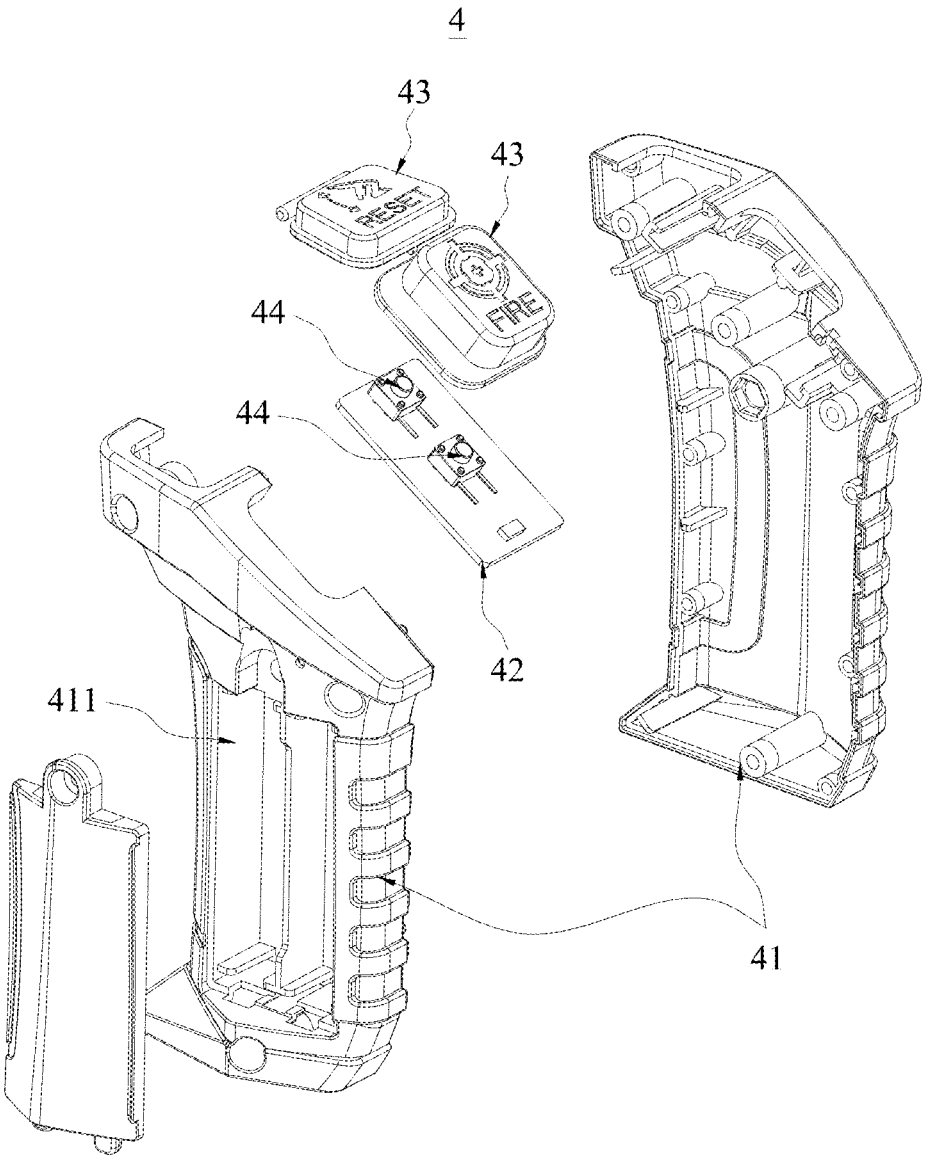
FIG. 10 is a schematic structural diagram of a control device in some embodiments of the present disclosure.

As shown in FIG. 1, in some embodiments of the posture sensing toy 10, the posture sensing toy further includes a control device 4. As shown in FIG. 10, the control device 4 includes a handle 41, a control circuit board 42, a plurality of control buttons 43, and a plurality of control switches 44. The control circuit board 42 is arranged inside the handle 41. The control switches 44 are respectively connected to the control circuit board 42. The control buttons 43 are respectively movably arranged on the handle 41. The control buttons 43 resist against the control buttons 43 in a one-to-one correspondence manner. The control circuit board 42 is in communicative connection with the main control mechanism 16.

It can be understood that the handle 41 is designed for being held by a user, and its appearance is preferably configured to adapt to the contour of a hand of the user, to ensure an operation comfort level and stability. The control circuit board 42 is arranged inside the handle 41. A communication module for remote communication is arranged on the control circuit board 42. The control circuit board 42 is in communicative connection with the main control mechanism 16 through the communication module. The control buttons 43 are operated by a user. After the control buttons 43 are pressed to trigger the control switches 44, the control circuit board 42 can transmit a corresponding signal to the main control mechanism 16.

It should be noted that after manual inputting through the control device 4, the user can remotely control the mechanical arm 1 to perform a corresponding function, for example, a one-click reset function: the circumferential adjustment mechanism 14 and the pitching adjustment mechanism 15 respectively drive the main arm mechanism 12 and the actuator 13 to move to initial positions; and for another example, a launching function: the mechanism can launch a launched object from a current position.

As shown in FIG. 10, in some embodiments, the handle 41 is provided with a battery slot 411 which is configured to store the battery. The battery is electrically connected to the control circuit board 42.

It can be understood that the battery can be configured as a detachable or non-detachable battery. Further, the battery can also be configured as a rechargeable battery or a one-shot battery.

Figure 11:
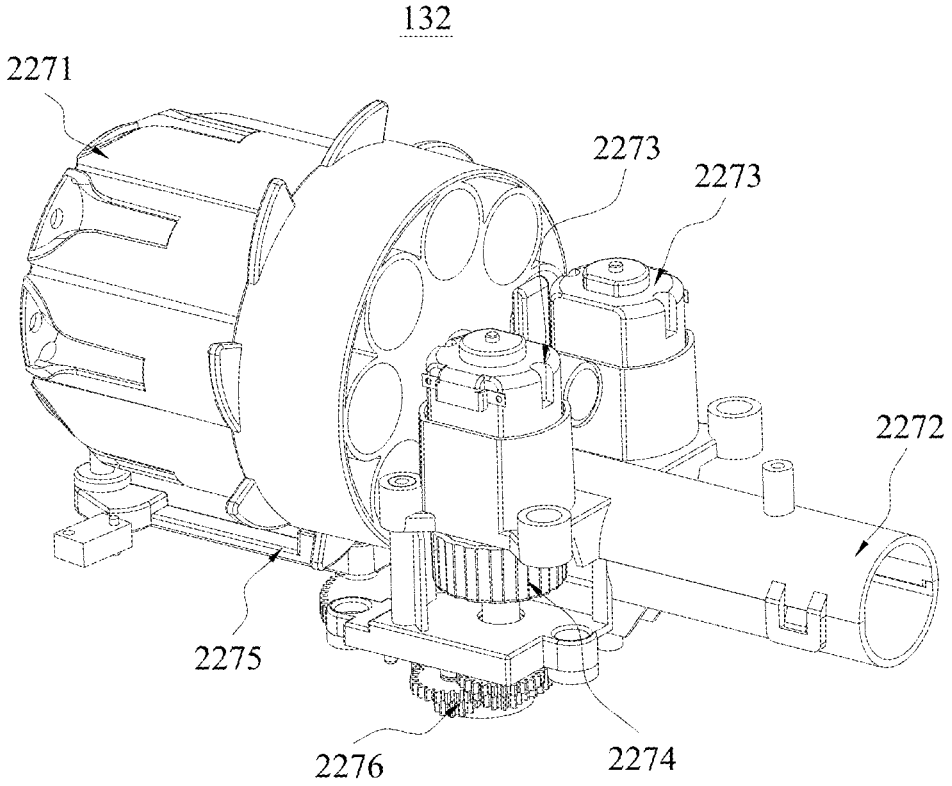
FIG. 11 is a schematic structural diagram of a launching assembly in some embodiments of the present disclosure.
Figure 12:
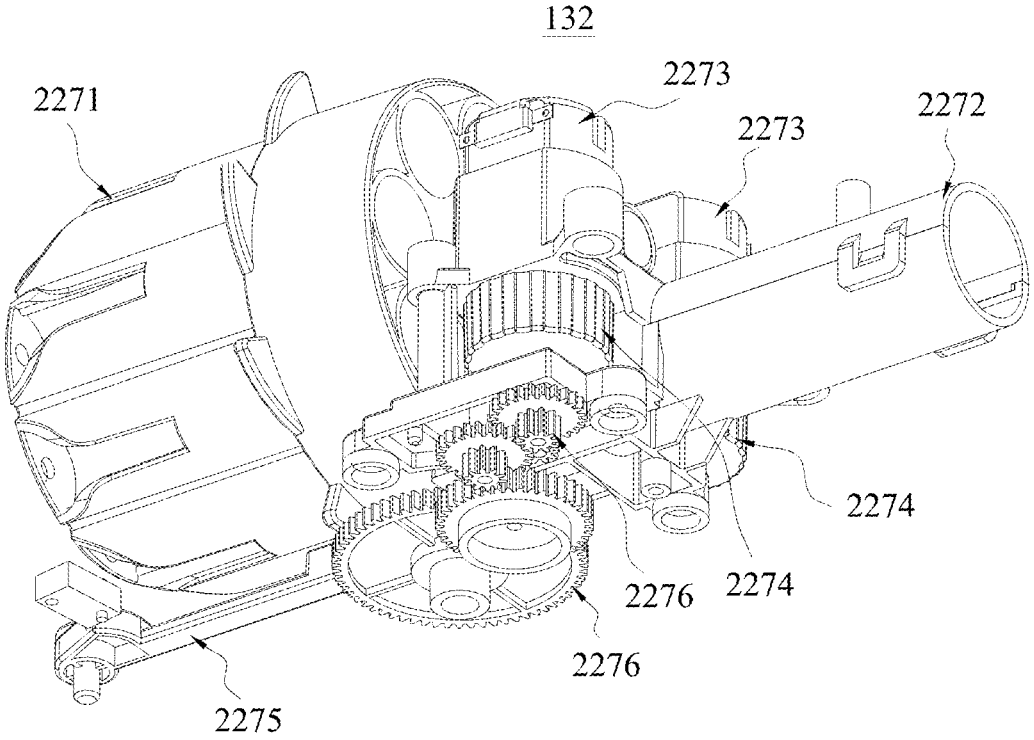
FIG. 12 is an exploded view of the launching assembly shown in FIG. 11.

As shown in FIG. 11 and FIG. 12, in some embodiments of the present disclosure, the soft bullet launching element includes a magazine 2271, a barrel 2272, two launching motors 2273, and two friction wheels 2274.

The magazine 2271 and the two launching motors 2273 are respectively arranged on an actuator arm 225. The two launching motors 2273 are electrically connected to a power supply device, and the two launching motors 2273 are in driving connection to the two friction wheels 2274 in a one-to-one correspondence manner. The barrel 2272 is arranged on the actuator arm 225 and is aligned with the magazine 2271.

The magazine 2271 is configured to accommodate a launched object. The launching motors 2273 are configured to drive the friction wheels 2274 to rotate, and the two friction wheels 2274 are configured to jointly press against the launched object during rotation and launch it into the barrel 2272, so that the launched object is shot along the barrel 2272.

It can be understood that the magazine 2271 is configured to an object to be launched, and implements automatic bullet feeding through other mechanical pushing, that is, the launched object in the magazine 2271 is pushed through a mechanical structure to a predetermined position for launching. The barrel 2272 is cylindrical and has two open ends. The launched object is launched into one end of the barrel 2272, and then a cylindrical structure of the barrel 2272 guides the launched object to move in a predetermined direction. The launched object is shot from the other end of the barrel 2272. The launching motors 2273 are configured to convert electrical energy of the power supply device into a torque, and each of the two launching motors 2273 respectively control a rotation state of one friction wheel 2274. The two friction wheels 2274 symmetrically clamp the launched object, and the two friction wheels 2274 respectively rotate in different directions, so that the two friction wheels 2274 can drive the launched object to move while rotating, to endow a speed to the launched object.

It should be noted that based on the content of this embodiment, the movement of the mechanical arm can implement adjustment on a launching angle in two directions, thus improving flexibility of the launching angle.

As shown in FIG. 11 and FIG. 12, in some embodiments of the present disclosure, the soft bullet launching element further includes a loading and sliding member 2275 and a plurality of launching transmission gears 2276. The launching transmission gears 2276 are respectively rotatably arranged on the actuator arm 225 and are meshed in sequence. A first end of the loading and sliding member 2275 is slidably arranged on the actuator arm 225, and a second end of the loading and sliding member 2275 is rotatably connected to one launching transmission gear 2276, and another launching transmission gear 2276 is in driving connection with one launching motor 2273.

When the second end is driven to rotate by the launching transmission gears 2276, the first end slides relative to the actuator arm 225 to press the launched object in the magazine 2271 between the two friction wheels 2274, so that the two friction wheels 2274 respectively press against the launched object from two opposite sides.

It can be understood that the first end of the loading and sliding member 2275 is slidably arranged on the actuator arm 225, which can provide linear motion guidance to ensure that a trajectory of pushing the launched object overlaps or is parallel to an axis of the barrel 2272. The second end is rotatably connected to the launching transmission gears 2276, which can convert the rotation motion of the launching transmission gears 2276 into linear movement of the first end, thus implementing conversion of a mechanical energy transmission form. The number of launching transmission gears 2276 and a transmission ratio between every two launching transmission gears 2276 can be flexibly set, and are adjusted based on a design and usage requirement of the product.

If one launching transmission gear 2276 is in driving connection to the launching motor 2273, the launching transmission gear 2276 can receive power of the launching motor 2273 and transmit the power to other launching transmission gears 2276 that are subsequently meshed.

It should be noted that direct pressing performed by the loading and sliding member 2275 on the launched object can avoid the problem of jamming on the launched object and improve a success rate of loading and launching.

One launching motor 2273 is in driving connection to both the friction wheel 2274 and the launching transmission gears. A torque output by the launching motor 2273 can be simultaneously transmitted to both the friction wheel and the launching transmission gears. Specifically, the launching motor 2273 can be configured as a dual-head output motor, or a transmission shaft can be arranged at an output end of the launching motor 2273. The friction wheel and one launching transmission gear 2276 are respectively sleeved at different positions on the transmission shaft, so that the transmission shaft can simultaneously drive the launching transmission gear 2276 and the friction wheel during rotating.

Figure 13:
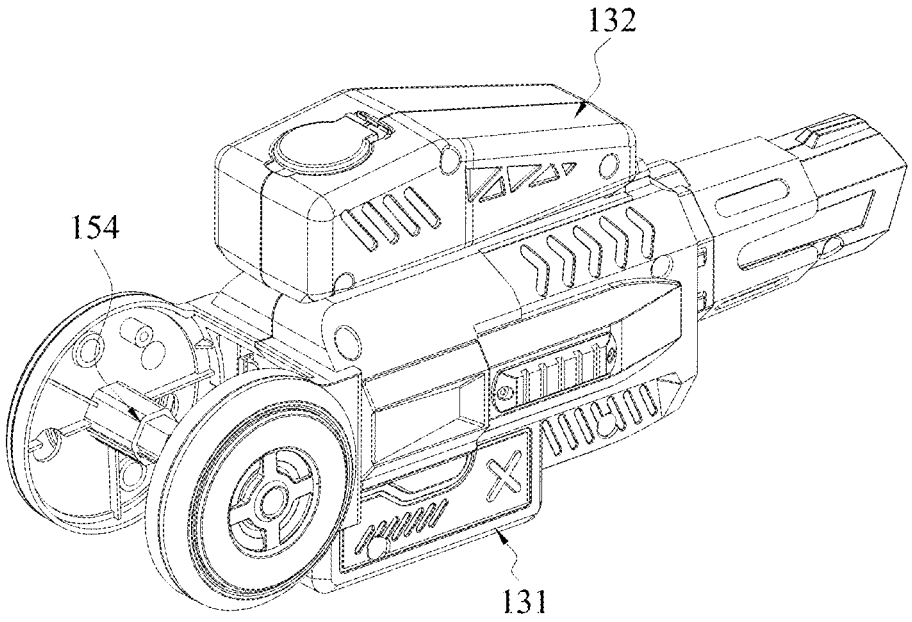
FIG. 13 is a schematic structural diagram of a launching assembly in some other embodiments of the present disclosure.
Figure 14:
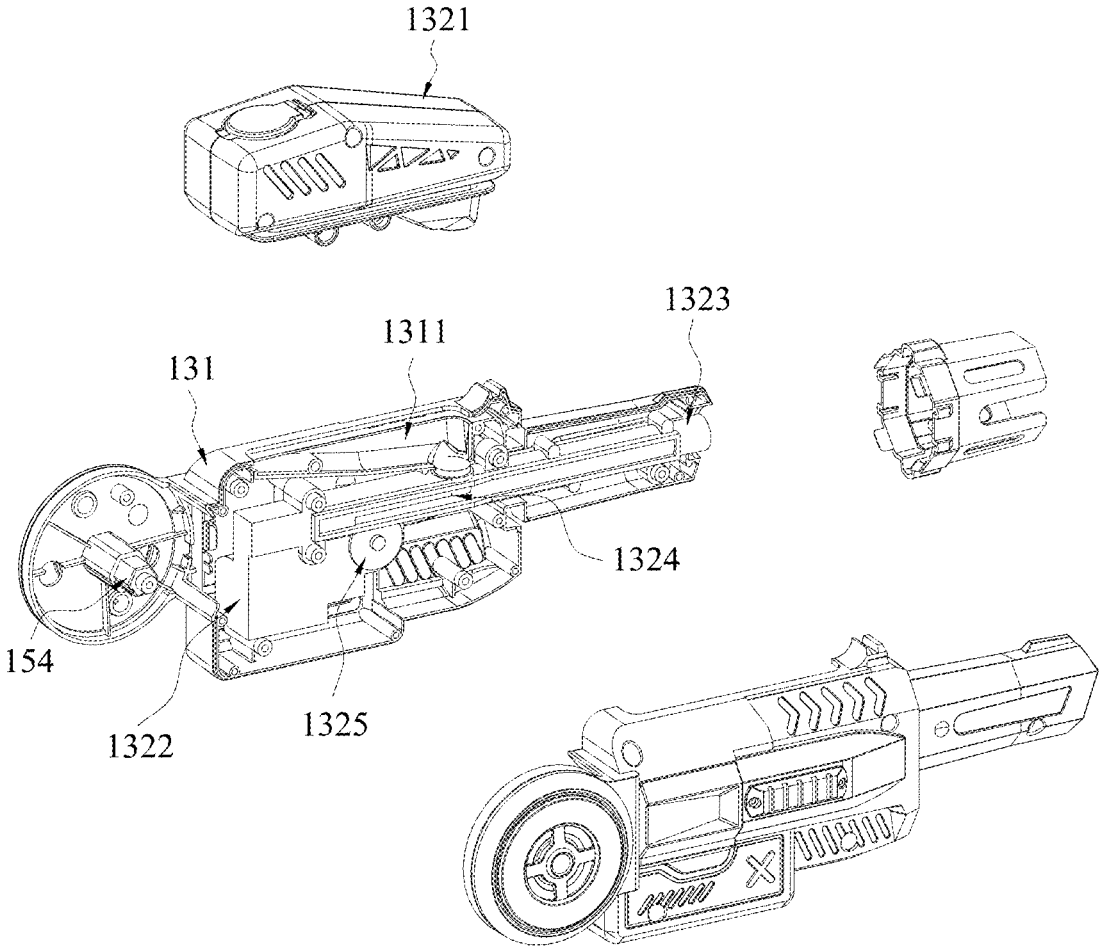
FIG. 14 is an exploded view of the launching assembly shown in FIG. 13.

As shown in FIG. 13 and FIG. 14, in some embodiments, the water bullet launching element includes a bullet storage box 1321, a water bullet launching motor 1322, a water bullet launching cylinder 1323, a water bullet launching piston 1324, and a water bullet launching gear transmission structure 1325.

The bullet storage box 1321 is arranged on the actuator base 131. A guide channel is formed in the actuator base 131. The guide channel 1311 is communicated to the bullet storage box 1321. The water bullet launching motor 1322 and the water bullet launching cylinder 1323 are respectively arranged on the actuator base 131, and the water bullet launching cylinder 1323 is communicated to the guide channel 1311. The water bullet launching gear transmission structure 1325 is arranged on the actuator base 131. The water bullet launching motor 1322 is in driving connection to the water bullet launching gear transmission structure 1325. The water bullet launching gear transmission structure 1325 is in driving connection to the water bullet launching piston 1324. The water bullet launching piston 1324 is slidably arranged inside the water bullet launching cylinder 1323.

It can be understood that the bullet storage box 1321 is configured to store a water bullet. The water bullet launching motor 1322 is configured to output a torque when powered on and working. The water bullet launching gear transmission structure 1325 is configured to: receive the torque output by the water bullet launching motor 1322 and further transfer the torque to the water bullet launching piston 1324, so that the water bullet launching piston 1324 can slide along an inner wall surface of the water bullet launching cylinder 1323. The water bullet launching cylinder 1323 is configured to receive a water bullet falling through the guide channel 1311. In a reciprocating motion process of the water bullet launching piston 1324, the water bullet pressed inside the water bullet launching cylinder 1323 moves and is endowed with kinetic energy, so that the water bullet moves along the water bullet launching cylinder 1323 and is shot.

The present disclosure has the following beneficial effects:

The present disclosure relates to a posture sensing toy. The circumferential posture sensing mechanism and the pitching posture sensing mechanism that are included in the posture control device are provided, and the circumferential posture sensing mechanism and the pitching posture sensing mechanism are respectively fixedly arranged on the first wearable mechanism and the second wearable mechanism of the wearable device, so that after wearing the toy, a user can trigger a control signal by changing body postures.

Meanwhile, the main control mechanism is in communicative connection with the circumferential posture sensing mechanism and the pitching posture sensing mechanism, and the main control mechanism is electrically connected to the circumferential posture sensing mechanism and the pitching posture sensing mechanism respectively, so that a product simplifies a toy operation flow, significantly lowers the difficulty of use, and improves convenience when the circumferential posture sensing mechanism and the pitching posture sensing mechanism act.

The schemes of the present disclosure have been described in more details above with reference to the accompanying drawings. In the foregoing embodiments, the description of each embodiment has respective focuses. For a part that is not described in detail in an embodiment, reference may be made to related descriptions in other embodiments. Those skilled in the art should also be aware that the actions and modules involved in this specification may not be necessary for the present disclosure. Furthermore, it can be understood that the steps in the method of the embodiments of the present disclosure can be sequentially adjusted, merged, and deleted according to actual needs. The modules in the device of the embodiments of the present disclosure can be merged, partitioned, and deleted according to actual needs.

The above has described the various embodiments of the present disclosure. The above explanation is exemplary, not exhaustive, and is not limited to the various embodiments disclosed herein. Many modifications and changes are obvious to those of ordinary skill in the art without deviating from the scope and spirit of the various embodiments described herein. The selection of the terms used herein aims to best explain the principles and practical applications of the various embodiments or improvements to technologies in the market, or to enable other persons of ordinary skill in the art to understand the various embodiments disclosed herein.

What is claimed is:

1. A posture sensing toy, comprising:

a mechanical arm comprising a supporting mechanism, a main arm mechanism, an actuator, a circumferential adjustment mechanism, a pitching adjustment mechanism, and a main control mechanism, wherein one end of the main arm mechanism is rotatably arranged on the supporting mechanism; the actuator is rotatably arranged at another end of the main arm mechanism; the circumferential adjustment mechanism is configured to drive the supporting mechanism and the main arm mechanism to relatively rotate; the pitching adjustment mechanism is configured to drive the actuator and the main arm mechanism to relatively rotate; the main control mechanism is arranged on the supporting mechanism; the main control mechanism is electrically connected to the circumferential adjustment mechanism and the pitching adjustment mechanism respectively;

a wearable device comprising a first wearable mechanism and a second wearable mechanism, wherein both the first wearable mechanism and the second wearable mechanism are for wearing; the first wearable mechanism is connected to the supporting mechanism; and a posture control device comprising a circumferential posture sensing mechanism and a pitching posture sensing mechanism, wherein the circumferential posture sensing mechanism is arranged on the first wearable mechanism; the pitching posture sensing mechanism is arranged on the second wearable mechanism; and the first wearable mechanism and the second wearable mechanism are respectively in communicative connection with the main control mechanism.

2. The posture sensing toy according to claim 1, wherein the circumferential posture sensing mechanism comprises a circumferential posture sensor; the circumferential posture sensor is arranged on the first wearable mechanism; the pitching posture sensing mechanism comprises a pitching posture sensor; the pitching posture sensor is arranged on the second wearable mechanism;

the main control mechanism comprises a main control circuit board; the main control circuit board is arranged inside the supporting mechanism; the main control circuit board is electrically connected to the circumferential adjustment mechanism and the pitching adjustment mechanism respectively; and the circumferential posture sensor and the pitching posture sensor are respectively in communicative connection with the main control circuit board.

3. The posture sensing toy according to claim 2, wherein the circumferential posture sensor comprises a first gyroscope sensor; and/or the pitching posture sensor comprises a second gyroscope sensor.

4. The posture sensing toy according to claim 1, wherein the first wearable mechanism comprises a body fixing plate, a cover plate, and a fixed seat; a mounting slot is formed in the body fixing plate; the circumferential posture sensor is arranged in the mounting slot; the cover plate is covered at the mounting slot; and the fixed seat is connected to the body fixing plate.

5. The posture sensing toy according to claim 4, wherein a fixing strap is arranged on the body fixing plate; and/or the body fixing plate is provided with a wearable vest.

6. The posture sensing toy according to claim 1, wherein the second wearable mechanism comprises a headset and a battery; the headset is provided with an accommodating cavity; the battery and the pitching posture sensing mechanism are respectively arranged in the accommodating cavity; and the battery is electrically connected to the pitching posture sensing mechanism.

7. The posture sensing toy according to claim 1, wherein the supporting mechanism comprises a supporting seat and a buckle; the buckle is arranged on the supporting seat; the main arm mechanism is rotatably arranged on the supporting seat; the supporting seat is detachably arranged on the first wearable mechanism; and the buckle is movably fastened to the first wearable mechanism.

8. The posture sensing toy according to claim 7, wherein the circumferential adjustment mechanism comprises a circumferential adjustment motor, a circumferential adjustment gear set, a circumferential driving gear, and a circumferential driving shaft; the circumferential adjustment motor is arranged on the supporting seat; the circumferential adjustment motor is electrically connected to the main control mechanism; the circumferential adjustment motor is in driving connection to the circumferential adjustment gear set; the circumferential adjustment gear set is meshed with the circumferential driving gear; the circumferential driving shaft is arranged on the main arm mechanism; the circumferential driving shaft is inserted into the circumferential driving gear; and the circumferential adjustment motor is configured to drive the circumferential driving gear to rotate through the circumferential adjustment gear set, so that the circumferential driving gear drives the main arm mechanism to rotate through the circumferential driving shaft.

9. The posture sensing toy according to claim 1, wherein the pitching adjustment mechanism comprises a pitching adjustment motor, a pitching adjustment gear set, a pitching driving gear, and a pitching driving shaft; the pitching adjustment motor is arranged on the main arm mechanism; the pitching adjustment motor is electrically connected to the main control mechanism; the pitching adjustment motor is in driving connection to the pitching adjustment gear set; the pitching driving gear is meshed with the pitching adjustment gear set; the pitching driving shaft is arranged on the actuator; the pitching driving shaft is inserted into the pitching driving gear; and the pitching adjustment motor is configured to drive the pitching adjustment gear set to rotate through the pitching driving gear, so that the pitching driving gear drives the actuator to rotate through the pitching driving shaft.

10. The posture sensing toy according to claim 1, wherein the actuator comprises an actuator base and a launching assembly; the actuator base is rotatably arranged on the main arm mechanism; the launching assembly is arranged on the actuator base; the launching assembly is electrically connected to the main control mechanism; the launching assembly comprises a soft bullet launching element or a water bullet launching element; and/or the posture sensing toy further comprises a control device; the control device comprises a handle, a control circuit board, a plurality of control buttons, and a plurality of control switches; the control circuit board is arranged inside the handle; the control switches are respectively connected to the control circuit board; the control buttons are respectively movably arranged on the handle; the control buttons resist against the control buttons in a one-to-one correspondence manner; and the control circuit board is in communicative connection with the main control mechanism.

* * * * *